United States Patent [19]

Parker et al.

[11] 4,315,398

[45] Feb. 16, 1982

[54] OPEN-END SPINNING APPARATUS

[75] Inventors: Alan Parker, Bolton; William M. Farnhill, Burnley, both of England

[73] Assignee: Platt Saco Lowell Ltd., England

[21] Appl. No.: 88,262

[22] Filed: Oct. 25, 1979

[30] Foreign Application Priority Data

| | | | |
|---|---|---|---|
| Oct. 26, 1978 | [GB] | United Kingdom | 42074/78 |
| Jun. 6, 1979 | [GB] | United Kingdom | 26163/79 |
| Aug. 4, 1979 | [GB] | United Kingdom | 27245/79 |

[51] Int. Cl.[3] ..... D01H 1/12; D01H 7/898

[52] U.S. Cl. ..... 57/58.95; 57/58.89

[58] Field of Search ..... 57/58.89–58.95

[56] References Cited

U.S. PATENT DOCUMENTS

| | | | |
|---|---|---|---|
| 4,107,909 | 8/1978 | Fehrer et al. | 57/58.95 X |
| 4,130,983 | 12/1978 | Dammann et al. | 57/58.89 X |
| 4,168,601 | 9/1979 | Didek et al. | 57/58.89 X |
| 4,202,163 | 5/1980 | Turk et al. | 57/58.89 X |
| 4,249,368 | 2/1981 | Fehrer | 57/58.95 X |

FOREIGN PATENT DOCUMENTS 12338 of 1977 Japan .

*Primary Examiner*—Donald Watkins

*Attorney, Agent, or Firm*—Donald H. Feldman

[57] ABSTRACT

A friction spinning apparatus comprises an opening roller system for feeding fibres in a feed duct to the throat formed between the adjacent peripheral surfaces of two parallel drums rotating in the same direction. Yarn formed at the throat, by frictional contact between the fed fibres and the surfaces, is withdrawn along the throat. The fibre feed duct is arranged to feed the fibres in an airstream having a direction inclined to the yarn axis and providing a component of fiber movement opposite to the direction of yarn withdrawal. A suction opening in the duct wall facing away from the drums causes an additional airstream across the duct parallel to the yarn axis to turn the fibres from the direction of inclination to a direction more nearly parallel to the yarn axis as they approach the throat. One of the drums is perforated for suction through its surface, the other is imperforate and formed with a resilient surface of a rubber material.

28 Claims, 5 Drawing Figures

OPEN-END SPINNING APPARATUS

FIELD OF THE INVENTION

This invention relates to apparatus for the open-end spinning of textile yarns, and particularly to a friction spinning apparatus comprising at least one yarn formation surface, a fibre feed duct for conveying fibres onto the surface, means for moving the surface to twist the fibres deposited thereon to form a yarn and means for withdrawing the yarn transversely to the direction of motion of the surface.

In one known example of friction spinning apparatus of this type the fibres are fed into a throat formed between the adjacent peripheral surfaces of two parallel drums rotating in the same direction. By frictional contact with the moving drum surfaces the fibres in the throat are twisted into a yarn which is then withdrawn transversely of the movement of the drum surfaces. In a further known example the fibres are fed onto a moving perforated belt where the fibres are maintained in a yarn formation zone defined by a suction nozzle positioned beneath the belt and are twisted into a yarn by the moving belt. The yarn is then withdrawn in a direction transverse to the direction of movement of the belt.

BACKGROUND OF THE INVENTION

A problem that arises with open-end spinning apparatus of this type is the unsatisfactory deposit of the fibres in the region of the tail end of spun yarn for incorporation therein.

One example for achieving an improved deposit of fibres is disclosed in British Pat. No. 1,524,659 and comprises two closely spaced apart perforated suction drums which rotate in the same direction and define between them a throat into which the fibres are fed from fibre feeding means and formed into a yarn. Disposed in the path of the fibres between the fibre feed means and the throat is a toothed disc or throwing member arranged for rotation in a plane transverse to the direction of movement of the fibres. The fibres, it is said, impinge upon and are deflected by the teeth on the rotating disc so that they are orientated to lie in a direction parallel to the movement of the spun yarn.

A disadvantage of this solution is that some of the fibres wrap around the teeth so that they tend to be removed from the mainstream of fibres, which is unacceptable. With this solution it is not possible to locate the rotating disc close to the yarn formation zone because of the physical limitations imposed by the rotating drums. Thus after contact with the teeth the fibres would lose the parallel orientation before reaching the yarn formation zone. Furthermore, the provision of a rotating disc requires additional drive means, thereby complicating the apparatus and introducing a source of possible failure to the system.

In a further known proposal disclosed in U.S. Pat. No. 4,130,983, referring particularly to the apparatus disclosed in FIGS. 6*a* and 6*b*, a pair of closely spaced apart perforated suction drums, which rotate in the same direction, define between them a throat into which the fibres are fed from fibre feed means through a fibre feed duct. An air injector is provided adjacent the peripheral surface of the beater at the entrance end of the fibre feed duct. The fibre feed duct is inclined so that fibres conveyed therethrough move with a component of direction the same as that of the withdrawn yarn. However, it is believed that in practice this arrangement will not orient the fibres to the best advantage.

In a further known proposal U.S. Pat. No. 4,168, 601 discloses a detailed openend spinning system of this general type, but does not give particular reference to the problem of proper orientation of fibres within the yarn as it is spun.

Additionally a very early system of this general trend is disclosed in British Pat. No. 1,231, 198. However this proposal had a number of serious faults and could not successfully spin an acceptable yarn.

SUMMARY OF THE INVENTION

It is an object of the invention to provide an improved friction spinning apparatus and particularly one wherein the orientation of fibres in the yarn is improved by improvements to the fibre feed arrangement.

These improvements are obtained in a number of ways. Firstly the fibre feed duct is arranged to feed the fibres directly onto the area from which the yarn is withdrawn and in a direction which is inclined to the direction of yarn withdrawal and with a component of motion opposite thereto. This has suprisingly been found to provide improved yarn strength characteristics, which is an indication of improved orientation of fibres within the yarn.

Additionally, improvement is obtained by the provision in the fibre feed duct of an additional air stream in a direction generally parallel to the yarn axis and at a location adjacent the twisting surface. Particularly, the airstream is not disturbed by other additional airstreams injected into the feed tube and the air is allowed to escape freely through a suction opening in the wall of the feed tube.

DESCRIPTION OF THE PREFERRED EMBODIMENT

Figure 1:
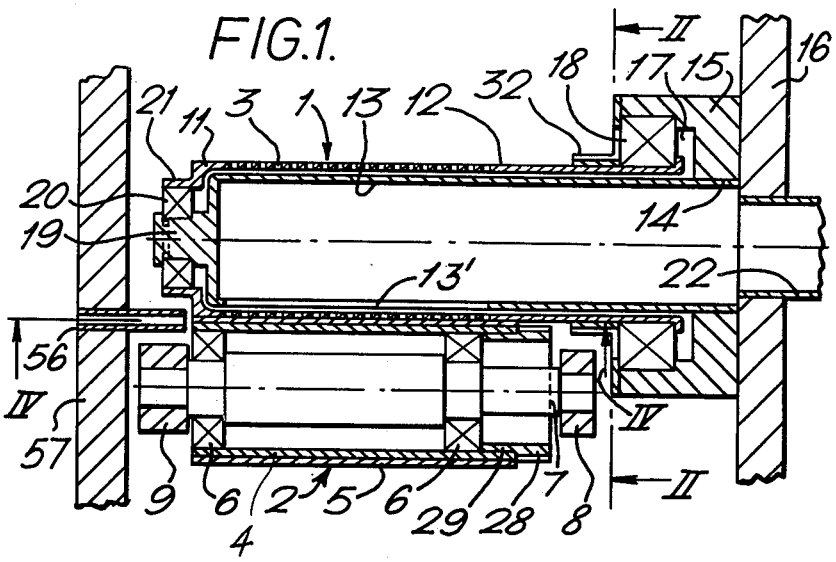
FIG. 1 is a sectional plan view of an open-end spinning apparatus according to the invention, with the section taken along the line I—I in FIG. 2.
Figure 5:
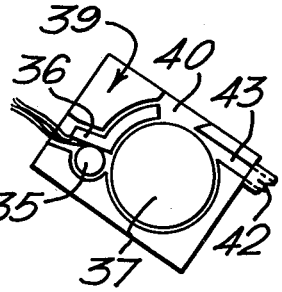
FIG. 5 is a partial plan view of the apparatus showing in more detail the opening roller arrangement.

The apparatus comprises a pair of parallel, closely spaced drums 1 and 2. The surface of the drum 1 includes a portion which is perforated as shown at the area 3, which is cross-hatched in FIG. 4.

The drum 2 is formed of a metal core cylinder 4 on which is bonded a cylindrical shell or coating 5 of a resilient material, preferably a natural or synthetic rubber such as polyurethane, adiprene or caprolactone. It has no perforations. The thickness of the shell is of the order of 2 mm and the hardness of the material lies in the range 40 to 90 Shore A and most advantageously 60 Shore A. The peripheral surfaces of the drums 1, 2 define between them a gap which tapers towards a narrow throat at the point of closest approach.

Figure 2:
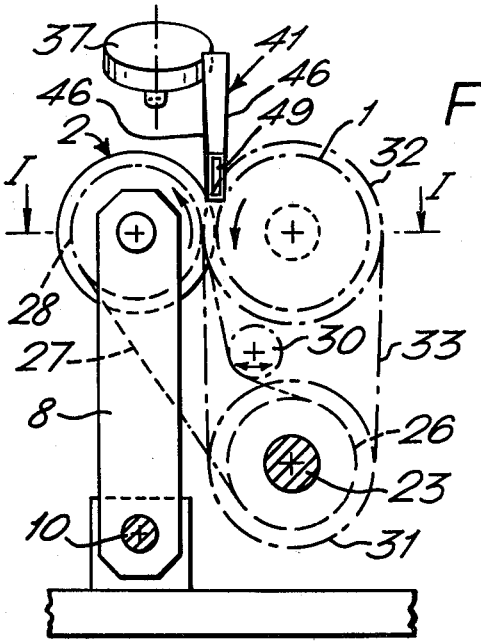
FIG. 2 is a section along the line II—II in FIGS. 1 and 3.
Figure 3:
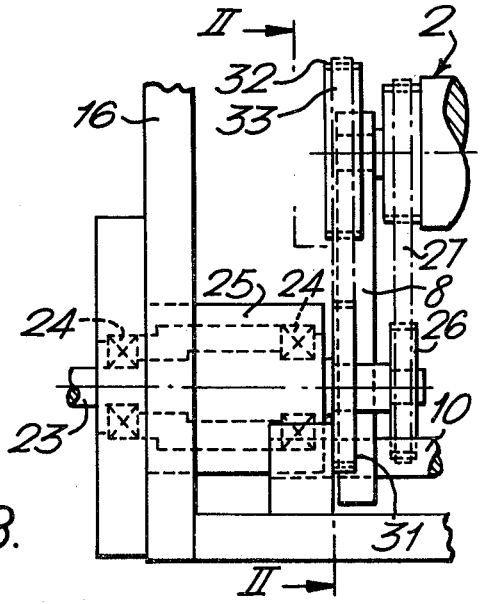
FIG. 3 is a partial schematic side view of the apparatus of FIG. 2 showing only the drive arrangements for the drums 1 and 2, and with the drum 1 removed for clarity.

The cylinder 4 of the roller 2 is carried upon ball bearings 6 for free rotation about a shaft 7 which supports the bearings 6. The shaft itself is rigidly supported in respective bores in a pair of arms 8, 9 which as shown in FIG. 2 are pivotally mounted on bar 10, and about which the arms 8, 9 and thence the roller 2 can be pivoted to increase or decrease the gap between the rollers 1 and 2.

The roller 1 comprises the perforated cylindrical portion 3 and imperforate extensions 11 and 12 which act to give support and rigidity to the portion 3. Within the roller 1 is mounted a suction tube 13 which comprises an elongate cylinder forming a tight clearance, of the order of 1 or 2 thousands of an inch, with the roller such that the roller is free to rotate about the tube 13. The tube 13 includes a slot 13' adjacent the throat between the rollers 1 and 2 to communicate suction within the tube 13 to the throat as will be explained hereinafter.

The tube 13 is rigidly mounted at one end by insertion within a bore 14 formed in a support 15 fixed to a machine frame 16 against which the end of the tube 13 abuts. The bore 14 is opened out to form a cylindrical cavity 17 in support 15 so as to provide a housing for a bearing 18 which rotatably supports one end of the perforated drum 1.

The other end of the tube 13 is closed and reduced in cross-section to provide a boss 19 on which is supported a bearing 20 for rotatably supporting a reduced diameter portion 21 at the end of the drum 1. The interior of the tube 13 communicates with a source of suction 22 which comprises a duct extending through the machine frame 16.

The drive for the drums 1 and 2 is derived from a motor (not shown) which is drivingly connected to one end of a countershaft 23 rotatably supported by a pair of bearings 24 mounted in a housing 25. The other end of the countershaft 23 supports on its end a timing belt pulley 28. A timing belt 27 wraps around the pulley 26 and around a timing belt pulley 28 which, as best seen in FIG. 1, is supported at the end of the drum 2 by a spigot 29 extending into the interior of the cylinder 4 of the drum 2. A tension pulley 30 engages the timing belt 27 which can be adjusted so as to provide the correct driving tension in the belt for different sizes of pulleys 26 whereby different speed ratios of the drums can be obtained.

Also supported on the countershaft 23 at a position intermediate the pulley 26 and the housing 25 is a further timing belt pulley 31 mounted directly beneath a timing belt pulley 32 which is fixedly attached to the peripheral surface of the drum 1 at a position adjacent to the bearing 18. The pulleys 31 and 32 are drivingly connected by a timing belt 33.

The drive from the main motor (not shown) is transmitted to the countershaft 23 so as to cause rotation of the pulleys 26 and 31 in a direction such that their respective belts drive the drums 1, 2 in the same direction, i.e. in an anti-clockwise direction as seen in FIG. 2. The rotation of the rums 1 and 2 is such that the periphery of drum 2 provided with the coating 5 moves out of the throat towards the side adjacent to the fibre feed duct 41 and the peripheral surface of the drum 1 provided with the perforated portion 3 moves from the side adjacent the fibre feed duct 41 into the throat.

A fibre feed apparatus, generally indicated at 34, comprises a sliver feed roller 35, a feed pedal 36, and a beater 37 mounted on a shaft 38 for rotation within a housing 39. The housing 39 has an opening 40 to permit the ejection of impurities therethrough. This type of fibre feed apparatus 34 is well-known in open-end spinning systems of the spinning rotor type and an example is described in more detail in British Pat. No. 1,368,886.

The fibres are conveyed from the fibre feed apparatus 34 to the throat formed between the peripheral surfaces of the drums 1, 2 by a fibre feed duct 41. The fibre feed duct 41 has a first duct portion 42 having a fibre inlet aperture in communication with a rectangular passage 43 provided in the housing and a second terminal duct portion or nozzle 44 which terminates in an elongate mouth 45 within the throat. The first duct portion 42 is of varying rectangular cross-section defined by two side walls 46, which gradually converge as the first duct portion 42 approaches the throat, and by a front wall 47 and a rear wall 48. The longitudinal axis of the first duct portion 42 is inclined at an angle of 20° to 45° and more preferably 25° to 30° with respect to the axis of the drums 1, 2.

At the junction of the first and second duct portions 42, 44 the front wall 47 terminates in an air channel or duct 49 which communicates with the terminal duct portion 44 for a purpose to be later described. The duct 49 extends from the terminal duct portion 44 in a direction generally parallel to the axes of the drums 1, 2 and is connected to a source of suction indicated schematically at 50. The walls of the first duct portion 47, 48 change direction abruptly to form walls 51, 52 of the terminal duct portion 44. The terminal duct portion 44 widens in the vicinity of the mouth 45 in that the rear wall 51 thereof extends from the entrance of the suction duct 53 to a position corresponding to one end of the slot 13' and in that the front wall 52 thereof is so angled as to extend to the other end of the slot 13'. Thus the mouth 45 extends as a narrow slot along substantially the whole length of the slot 13' so as to maximise the area of the mouth in communication with the slot 13'. The end of the wall 52 is spaced further along the axis of the yarn than is the imaginary end of the wall 47 where it would intersect the mouth 45. For a feed duct having an angle of inclination of the first duct part 42 of 25°, the best spacing of the imaginary point of intersection of the linear extention of wall 47 and mouth 45 from the end of the wall 52 at the mouth 45 has been found to be 25 mm (millimeters).

The duct 49 has upper and lower walls 53, 54 respectively which diverge as the duct extends away from the interior of the fibre feed duct 41. The lower wall 54 extends slightly upwardly as it approaches and conjoins with the front wall 52 to form a type of baffle. This baffle is disposed below the upper wall 53 at a position displaced from the junction between the walls 47 and 53.

The throat forms a yarn formation zone in which the fibres are twisted by rotation of the drums 1, 2 into a yarn 4 which is withdrawn axially of the drums 1, 2 along the throat by a pair of delivery rollers 55, located on the opposite side of the fibre feed duct 41 to that of the suction duct 49, and wound into a package 55*a*. The rotation wherein the drum 1 moves into the throat and the drum 2 moves out of the throat has been found to provide improved twisting efficiency relative to two perforated rollers with suction or one imperforate structured roller and one perforated suction roller. The drums give high twisting efficiency while allowing motion of the yarn axially without developing unacceptably high levels of tension. The direction of the rollers is important to give proper balance of the yarn in the throat. A yarn delivery tube 56 extends from a machine frame wall 57, in which it is fixedly mounted, to a position closely adjacent the ends of the drums 1, 2.

OPERATION OF THE INVENTION

In operation, a silver S is forwarded from the nip formed between the feed roller 35 and the feed pedal 36 to an opening and combing action effected by needles or teeth on the peripheral surface of the beater 37. The opened fibres are conveyed on the peripheral surface of the beater 37 to the entrance of the fibre feed passage 43 where they are removed from the beater 37. Impurities are ejected through the opening 40. In this passage 43 the fibres are entrained in an airstream derived from the source of suction connected to the interior of the tube 13 by the duct 22. This source of suction communicates with the passage 43 through the slot 13', the perforated portion 3, the mouth 45 and the fibre feed duct 41. After passing through the passage 43 the fibres are conveyed by the airstream along the first duct portion 42 in which they lie generally in axial alignment with the direction of flow of the airstream i.e. at approximately 25° to the axes of the drums 1, 2 and in a direction opposite to the direction of yarn withdrawal.

At the termination of the first duct portion 42 the fibres come under the influence of another airstream derived through the suction duct 49. The influence of this airstream causes a flow to be developed in a direction substantially parallel to the axis of the yarn. This airstream is not disturbed by any additional airstreams introduced into the feed duct so that a uniform flow without turbulence is obtained. This airstream causes the total flow of air and at least some of the entrained fibres to change their direction of motion. The feed tube feeds fibres, therefore, directly into the bottom of the throat, i.e. directly into the yarn formation zone and from where the yarn is withdrawn, with a direction which approaches a direction which is more nearly parallel to the axes of the drums 1, 2. The fact that the wall 52 is spaced further axially of the yarn than an imaginary extension of the wall 47 gives room for the fibres to turn to such a more parallel orientation and to be drawn downwards in such an orientation by the suction through the mouth 45. If however the foresaid spacing of the wall 52 along the axis is too great, then too great a turning effect is achieved and the proper effect lost. Thus there is a higher probability that fibres are incorporated into the tail end of the spun yarn 4 as they lie in parallel alignment, or substantially in alignment, with the axis of the yarn 4. The baffle formed by the walls 52 and 54 serves to prevent the airflow in the duct 49 from directly countering the airflow through the mouth 45 and hence to avoid removal of fibres from the yarn formation zone by the suction airstream created in the suction duct 49. The suction duct 49 communicates with the terminal duct portion 44 in the vicinity of the tail end of the yarn 4. This ensures that the suction from the duct 49 will at least influence those fibres which will form the core section of the yarn so that they have a higher probability of lying substantially parallel to the axis of the yarn as they are incorporated therein. Of the fibres constituting the yarn 4, those forming the core make a major contribution to the strength of the yarn, and it is important that these should be incorporated in the yarn in a satisfactory manner. It is also important to ensure that the respective air flows pulled by suction into the suction duct 49 and the suction slot 13' act on the fibres in a balanced relationship. The suction force pulling air into the duct 49 should not, of course, be of excessive strength so as to completely overcome the effect of the suction force acting on the air flow and entrained fibers moving towards the slot 13' otherwise useable because then fibres will be extracted through the duct 49, but rather should be of a magnitude sufficient to cause a redirection of the fibres so that they lie substantially or more nearly parallel to the axis of the yarn being formed at the throat. In practice it has been found that an air flow of the order of 32 cfm (cubic feet per minute) drawn through the tube 13 and slot 13' and 10 cfm an air flow of drawn through the duct 49 provides such a suitable balance. The duct 49 is arranged adjacent to the mouth 45 and the throat so as to act upon the fibres as close to the mouth as possible without interfering with the airstream through the mouth and thus removing fibres. It is believed that the entrained fibres in or exiting from the feed duct 41 have a tendency to turn axially from the feed airstream direction of 25° in duct portion 42 toward the vertical direction as they in the airstream come into the direct influence of the suction through the slot 13' at the mouth 45. The imposition of an additional air flow across mouth 45 and into the duct 49 opposes this tendency and acts to change the axial direction of the fibres so entrained that they approach the wall 52 at an angle more nearly parallel to the yarn axis at the throat than they would otherwise do.

Figure 4:
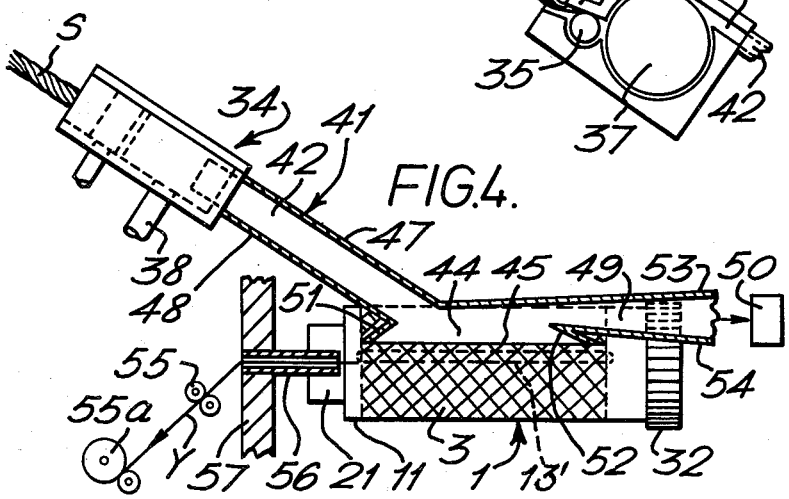
FIG. 4 is a section along the line IV—IV in FIG. 1.

Although possibly less desirable, the fibre feed duct 41 could be inclined in a direction opposite to that shown in FIG. 4. In such an arrangement the inclination of the longitudinal axis of the first ductportion will be 25° with respect to the axes of the drums 1, 2 and the fibre conveying airstream passing along this portion will convey the fibres in a direction corresponding to that of the spun yarn 4. The suction duct 49 would communicate with the fibre feed duct 41 through that wall adjacent the delivery rollers so as to influence the fibres and cause them to be redirected so as to lie in a direction substantially parallel to the axis of the spun yarn at the throat.

We claim:

1. An open end yarn spinning apparatus comprising a yarn formation surface, fiber feed means for feeding discrete fibers to said surface, fiber duct means for conveying said fibers from said fiber feed means to said yarn formation surface, surface moving means for moving said yarn formation surface in such a manner as to twist said discrete fibers conveyed thereto and deposited thereon to form a yarn thereby, yarn withdrawal means for withdrawing said formed yarn from said surface in a direction transverse to the direction of movement of said surface, and fiber entraining means for providing an airstream within said duct means to entrain said discrete fibers and move the same through said duct means from said fiber feed means to said yarn formation surface, wherein said fiber entraining means provides a component airstream moving substantially parallel to the axis of said yarn being formed whereby fibers entrained in said airstream toward said surface are turned to a direction more parallel to said yarn axis as said fibers approach said yarn formation surface.

2. Apparatus according to claim 1, wherein said duct means includes a duct for containing said airstream for transporting said fibres from said fibre feed means to said surface and wherein said fiber entraining means includes suction means effective adjacent said surface for providing said airstream.

3. Apparatus according to claim 2, wherein the apparatus is arranged such that the airstream coacts with the component airstream to provide a resultant airstream free from turbulence by and devoid of any additional airstreams introduced into said duct means.

4. Apparatus according to claim 3, wherein a baffle is provided in such an orientation relative said duct as to prevent said component airstream from directly opposing said airstream.

5. Apparatus according to claim 1, wherein said yarn formation surface is perforated and wherein said fiber entraining means includes a suction source which communicates with the side of said surface facing away from said fiber duct means.

6. Apparatus according to claim 1, wherein said duct means includes another duct through which said component airstream leaves the duct means.

7. Apparatus according to claim 6, wherein said fiber entraining means includes suction means for applying a suction to an end of said other duct to provide said component airstream.

8. Apparatus according to claim 6, wherein said duct is inclined relative to a direction normal to the axis of the yarn being formed and wherein said other duct is oriented more parallel to and by direction faces away from the yarn axis.

9. Apparatus according to claim 1, wherein said duct means includes a duct extending from said fiber feed means to adjacency of said fiber formation surface, another duct contiguous with said duct adjacent to said surface and extending away therefrom, and an elongate mouthpiece formed at the joining of said ducts, facing and opening along said fiber formation surface in a manner parallel to the axis of said yarn being formed there.

10. Apparatus according to claim 9, wherein the end of said duct at said mouthpiece terminates intermediate the elongate length of the opening of said mouthpiece and spaced inwardly away therefrom within said duct means.

11. Apparatus according to claim 9, wherein said other duct guides said component airstream in its course across said mouthpiece within said duct means.

12. Apparatus according to claim 9, wherein said duct is at an inclination to a direction normal to that of the axis of the yarn being formed, and said other duct is at an inclination more parallel to said axis than is said inclination of said duct.

13. Apparatus according to claim 12, wherein said ducts in the area of their contiguity and joining share a common wall opposite said elongate mouthpiece and that said wall changes direction from said inclination of said duct to said inclination of said other duct at the sectional line of contiguity of said ducts.

14. Apparatus according to claim 13, wherein an imaginary extention of said common wall at said inclination of said duct intersects said axis of yarn being formed at a point intermediate the ends of said mouthpiece.

15. Apparatus according to claim 9, wherein said other duct is connected at an end thereof extending away from said duct to a source of suction.

16. Apparatus according to claim 9, wherein said other duct is in an orientation to receive at least a substantial portion of said component airstream for exiting therethrough.

17. Apparatus according to claim 9, wherein said ducts are oriented relative one another and said mouthpiece such that said other duct may receive at least a substantial portion of said component airstream substantially devoid of entrained fibers for exiting therethrough.

18. Apparatus according to claim 9, wherein said airstream has an airflow through said mouthpiece to said surface of yarn formation in the order of about 32 cubic feet per minute and said component airstream has an airflow in the order of about 10 cubic feet per minute.

19. An open end yarn spinning apparatus comprising a yarn formation surface, fiber feed means for feeding discrete fibers to said surface, fiber duct means for conveying said fibers from said fiber feed means to said yarn formation surface, having a duct extending from said fiber feed means to an area adjacent to said yarn formation surface and forming thereat a mouthpiece, surface moving means for moving said yarn formation surface in such a manner as to twist said discrete fibers conveyed thereto and deposited thereon to form a yarn thereby, yarn withdrawal means for withdrawing said formed yarn from said surface in a direction transverse to the direction of movement of said surface, and fiber entraining means for providing two airstreams, the first to entrain said fibers from said fiber feed means and convey them through said duct toward said yarn formation surface, and the other to entrain said fibers in said duct means in the area of said mouthpiece and to coact with said first airstream to turn said fibers to an axial alignment more parallel to the axis of the yarn being formed at said surface in their movement toward said surface.

20. Apparatus according to claim 19, wherein said duct has side walls at least one of which includes a change in direction such that the duct opens to form a nozzle adjacent the elongate mouth.

21. Apparatus according to claim 20, wherein prior to the change in direction the side walls are substantially parallel.

22. Apparatus for open end spinning of yarn comprising a yarn formation surface, a fiber feed means, a fiber feed duct intercommunicating between said means and said surface permitting passage therethrough of fibers from said means to said surface, means for moving said surface for twisting said fibers deposited thereon from said duct to form yarn, means for withdrawing said formed yarn from said surface in a direction transverse to the direction of movement of said surface, and means for developing an airstream in a portion of said duct adjacent said surface whereby said airstream includes at least in part an airflow substantially parallel to the axis of said yarn being formed at said surface, and whereby fibers in said airstream approaching said surface are turned to a direction more nearly approaching one parallel to the axis of said yarn being formed.

23. Apparatus for open end spinning of yarn comprising a yarn formation surface,
fiber feed means,
a fiber feed duct formed with a mouth at one end adjacent said surface and having walls extending from said means to said mouth wherethrough fibers from said means may pass to said surface for deposit thereon,
means for moving said surface for twisting said fibers to form yarn at said surface, and
means for withdrawing said formed yarn from said surface in a direction transverse to the direction of movement of said surface,
wherein said duct is formed with an opening intermediate its length and
wherein means are provided for developing an airstream in said duct for movement toward said mouth such that at least some of the air thereof is caused to turn toward said opening and to exit therethrough.

24. Apparatus according to claim 23, wherein said airstream developing means includes suction means intercommunicating with said duct and its opening for applying suction thereto for causing at least some of said air to turn across said duct toward said opening and to exit therethrough.

25. Apparatus according to claim 23, wherein said duct is inclined relative to a direction normal to the axis of said formed yarn and wherein said opening is formed in a portion of said duct which portion faces away from said yarn axis.

26. Apparatus according to claim 25, wherein the end of said duct portion is spaced further along said yarn axis than is the intersection of an imaginary line extention of another portion of said duct opposite to said portion formed with said opening.

27. Apparatus for open end spinning of yarn comprising
a yarn formation surface,
fiber feed means,
a fiber feed duct formed with a mouth at one end adjacent said surface and having walls extending from said means to said mouth wherethrough fibers from said means may pass to said surface for deposit thereon,
means for developing a first airstream within and along said duct for movement toward said mouth for conveying said fibers from said feed means through said mouth to said surface,
means for moving said surface for twisting said deposited fibers to form a yarn,
means for withdrawing said formed yarn from said surface in a direction transverse to that of said first airstream, and
means for developing a second airstream in a portion of said duct adjacent said surface for coacting said first and second airstreams whereby at least some of said fibers as they are moved toward and approach said surface are reoriented such that their fiber axes change direction to one more nearly approaching a direction parallel to that of the axis of said yarn being formed, said airstreams being substantially free of disturbance by any additional airstreams within said duct.

28. Apparatus for open end spinning of yarn comprising
a yarn formation surface,
a fiber feed means,
a fiber feed duct intercommunicating between said means and said surface permitting passage therethrough of fibers from said means to said surface,
means for developing a first airstream within and along said duct for conveying said fibers from said feed means to said surface for deposit thereon,
means for moving said surface for twisting said deposited fibers to form a yarn,
means for withdrawing said formed yarn from said surface in a direction transverse to that of said first airstream, and
means for developing a second airstream within said duct adjacent to said surface in a direction transverse to that of said first airstream so as to change the axial orientation of at least some of said conveyed fibers to a direction more nearly approaching a direction parallel to the axis of said formed yarn.

* * * * *

UNITED STATES PATENT AND TRADEMARK OFFICE

CERTIFICATE OF CORRECTION

PATENT NO. : 4,315,398
DATED : Feb. 16, 1982
INVENTOR(S) : Alan Parker & William M. Farnhill It is certified that error appears in the above-identified patent and that said Letters Patent are hereby corrected as shown below:

Column 4, line 56, col.5, lines 48,50,57 and 62, and col. 6, line 36, "yarn 4" should read -- yarn Y --;

And col. 5, line 50, before ". The baffle" insert -- being formed at the throat --.

Signed and Sealed this

Second Day of November 1982

[SEAL]

*Attest:*

GERALD J. MOSSINGHOFF

*Attesting Officer*

*Commissioner of Patents and Trademarks*

REEXAMINATION CERTIFICATE (1568th)

United States Patent [19]

Parker et al.

[11] B1 4,315,398

[45] Certificate Issued Oct. 15, 1991

[54] OPEN-END SPINNING APPARATUS

[75] Inventors: Alan Parker, Bolton; William M. Farnhill, Burnley, both of England

[73] Assignee: Platt Saco Ltd., London, England

Reexamination Request:
No. 90/001,914, Dec. 15, 1989

Reexamination Certificate for:

| | |
|---|---|
| Patent No.: | **4,315,398** |
| Issued: | **Feb. 16, 1982** |
| Appl. No.: | **88,262** |
| Filed: | **Oct. 25, 1979** |

Certificate of Correction issued Nov. 2, 1982.

[30] Foreign Application Priority Data

| | | | |
|---|---|---|---|
| Oct. 26, 1978 | [GB] | United Kingdom | 42074 |
| Jun. 6, 1979 | [GB] | United Kingdom | 26163 |
| Aug. 4, 1979 | [GB] | United Kingdom | 27245 |

[51] Int. Cl.[5] ..... D01H 4/16; D01H 4/34

[52] U.S. Cl. ..... 57/401; 57/411

[58] Field of Search ..... 57/401, 408, 411, 412, 57/413, 415

[56] References Cited

U.S. PATENT DOCUMENTS

| | | | |
|---|---|---|---|
| 3,884,029 | 5/1975 | Ripka et al. | 57/413 X |
| 4,107,909 | 8/1978 | Fehrer et al. | 57/5 |
| 4,130,983 | 12/1978 | Dammann et al. | 57/5 |
| 4,168,601 | 9/1979 | Didek et al. | 57/401 |
| 4,202,163 | 5/1980 | Turk et al. | 57/401 |
| 4,249,368 | 2/1981 | Fehrer | 57/5 |

FOREIGN PATENT DOCUMENTS

| | | |
|---|---|---|
| 2345541 | 10/1977 | France . |
| 12338 | 1/1977 | Japan . |

*Primary Examiner*—Joseph J. Hail, III

[57] ABSTRACT

A friction spinning apparatus comprises an opening roller system for feeding fibres in a feed duct to the throat formed between the adjacent peripheral surfaces of two parallel drums rotating in the same direction. Yarn formed at the throat, by frictional contact between the fed fibres and the surfaces, is withdrawn along the throat. The fibre feed duct is arranged to feed the fibres in an airstream having a direction inclined to the yarn axis and providing a component of fiber movement opposite to the direction of yarn withdrawal. A suction opening in the duct wall facing away from the drums causes an additional airstream across the duct parallel to the yarn axis to turn the fibres from the direction of inclination to a direction more nearly parallel to the yarn axis as they approach the throat. One of the drums is perforated for suction through its surface, the other is imperforate and formed with a resilient surface of a rubber material.

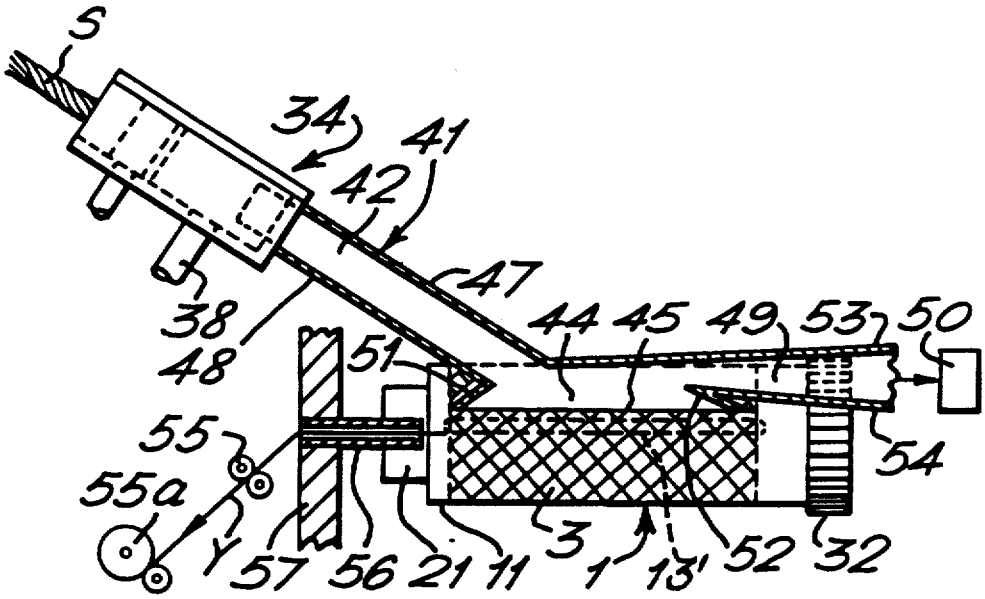

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-3 and 9 are cancelled.

Claims 4-8, 10-19 and 22-28 are determined to be patentable as amended.

Claims 20 and 21 dependent on an amended claim, are determined to be patentable.

New claims 29 and 30 are added and determined to be patentable.

4. Apparatus according to claim [3] *29*, wherein a baffle is provided in such an orientation relative said duct as to prevent said [component] *second* airstream from directly opposing said *first* airstream.

5. Apparatus according to claim [1] *29*, wherein said yarn formation surface is perforated and wherein said fiber entraining means includes a suction source which communicates with the side of said surface facing away from said fiber duct means *to provide said first suction means.*.

6. Apparatus according to claim [1] *29*, wherein said *fiber* duct means includes another duct through which said [component] *second* airstream leaves the *fiber* duct means.

7. Apparatus according to claim 6, wherein said fiber entraining means includes *said second* suction means for applying a suction to an end of said other duct to provide said [component] *second* airstream.

8. Apparatus according to claim 6, wherein [said duct is inclined relative to a direction normal to the axis of the yarn being formed and] wherein said other duct is oriented more parallel to *said axis of the yarn being formed than is said fiber feed duct* and by direction faces away from the yarn axis.

10. Apparatus according to claim [9] *30*, wherein the end of said *first* duct at said mouthpiece terminates intermediate the elongate length of the opening of said mouthpiece and spaced inwardly away therefrom within said *fiber* duct means.

11. Apparatus according to claim [9] *30*, wherein said [other] *second* duct guides said component airstream in its course across said mouthpiece within said *fiber* duct means.

12. Apparatus according to claim [9] *30*, wherein [said duct is at an inclination to a direction normal to that of the axis of the yarn being formed, and] said [other] *second* duct is at an inclination more parallel to said axis *of the yarn being formed than is said inclination* of said *first* duct.

13. Apparatus according to claim 12, wherein said *first and second* ducts in the area of their contiguity and joining share a common wall opposite said elongate mouthpiece and that said wall changes direction from said inclination of said *first* duct to said inclination of said [other] *second* duct at the sectional line of contiguity of said ducts.

14. Apparatus according to claim 13, wherein an imaginary extension of said common wall at said inclination of said *first* duct intersects said axis of yarn being formed at a point intermediate the ends of said mouthpiece.

15. Apparatus according to claim [9] *30*, wherein said [other] *second* duct is connected at an end thereof extending away from said *first* duct to a source of suction *which provides said second suction means.*

16. Apparatus according to claim [9] *30*, wherein said [other] *second* duct is in an orientation to receive at least a substantial portion of said component airstream for exiting therethrough.

17. Apparatus according to claim [9] *30*, wherein said *first and second* ducts are oriented relative one another and said mouthpiece such that said [other] *second* duct may receive at least a substantial portion of said component airstream substantially devoid of entrained fibers for exiting therethrough.

18. Apparatus according to claim [9] *30*, wherein said airstream has an airflow through said mouthpiece to said surface of yarn formation in the order of about 32 cubic feet per minute and said component airstream has an airflow in the order of about 10 cubic feet per minute.

19. An open end yarn spinning apparatus comprising a yarn formation surface, fiber feed means for feeding discrete fibers to said surface, fiber duct means for conveying said fibers from said fiber means to said yarn formation surface, having a duct extending from said fiber feed means to an area adjacent to said yarn formation surface and forming thereat a mouthpiece, surface moving means for moving said yarn formation surface in such a manner as to twist said discrete fibers conveyed thereto and deposited thereon to form a yarn thereby, *said duct extending obliquely to the axis of said yarn whereby the fibers in said fiber duct means have a component of movement parallel to said yarn axis,* yarn withdrawal means for withdrawing said formed yarn from said surface in a direction transverse to the direction of movement of said surface, and fiber entraining means [for providing two airstreams, the] *including a first suction means disposed behind a side of said yarn formation surface facing away from said fiber duct means for creating a first suction directed generally perpendicular to said yarn formation surface at said yarn formation surface, said first suction means providing a first airstream* to entrain said fibers from said fiber feed means and convey them through said duct toward said yarn formation surface, and [the other to] *including second suction means which includes a suction port disposed in said fiber duct means on a side of said yarn formation surface facing towards said fiber duct means and opposite said first suction means for creating a second airstream directed generally parallel to said yarn formation surface in the direction of said component of movement of the fibers in said fiber duct means thereby to* entrain said fibers in said duct means in the area of said mouthpiece and to coact with said first airstream to turn said fibers to an axial alignment more parallel to the axis of the yarn being formed at said surface in their movement toward said surface.

22. Apparatus for open end spinning of yarn comprising a yarn formation surface, a fiber feed means, a fiber feed duct intercommunicating between said means and said surface permitting passage therethrough of fibers from said *fiber feed* means to said surface,

*first suction means disposed behind a side of said yarn formation surface facing away from said fiber duct means for creating a first suction directed generally perpendicular to said yarn formation surface at said yarn formation surface;* means for moving said surface for twisting said fibers deposited thereon from said duct to form yarn, means for withdrawing said formed yarn from said surface in a direction transverse to the direction of movement of said surface, *said fiber feed duct being inclined to said yarn withdrawal direction whereby the fibers in said fiber feed duct have a component of movement parallel to said yarn axis,* and

*second suction* means *including a suction port disposed in said fiber feed duct on a side of said yarn formation surface facing towards said fiber duct means and opposite said first suction means* for developing *a second suction independent of said first suction means which creates* an airstream in a portion of said *fiber feed* duct adjacent said surface whereby said airstream includes at least in part an airflow substantially parallel to the axis of said yarn being formed at said surface, *and moving in the direction of said component of movement of the fibers in said fiber feed duct,* and whereby fibers in said airstream approaching said surface are turned to a direction more nearly approaching one parallel to the axis of said yarn being formed.

23. Apparatus for open end spinning of yarn comprising a yarn formation surface, fiber feed means, a fiber feed duct formed with [a] *an elongate* mouth at one end adjacent said surface *to define therewith a yarn formation line* and having walls extending from said *fiber feed* means to said mouth wherethrough fibers from said *fiber feed* means may pass to said surface for deposit thereon, *said fiber feed duct being inclined to said yarn formation line whereby the fibers in said fiber feed duct have a component of movement parallel to said yarn formation line,* means for moving said surface for twisting said fibers to form yarn *along said yarn formation line* at said surface, and means for withdrawing said formed yarn from said surface in a direction transverse to the direction of movement of said surface, wherein said duct is formed with an opening intermediate its length and wherein means are provided for developing an airstream in said *fiber feed* duct for movement toward said mouth such that at least some of the air thereof is caused to turn toward said opening and to exit therethrough *in a direction of said component of movement of the fibers in said fiber feed duct.*

24. Apparatus according to claim 23, wherein said airstream developing means includes suction means intercommunicating with said *fiber feed* duct and its opening for applying suction thereto for causing at least some of said air to turn across said *fiber feed* duct toward said opening and to exit therethrough.

25. Apparatus according to claim 23, wherein said [duct is inclined relative to a direction normal to the axis of said formed yarn and wherein said] opening is formed in a portion of said *fiber feed* duct which portion faces away from said yarn axis.

26. Apparatus according to claim 25, wherein the end of said duct portion is spaced further along said yarn axis than is the intersection of an imaginary line extension of another portion of said *fiber feed* duct opposite to said portion formed with said opening.

27. Apparatus for open end spinning of yarn comprising a yarn formation surface, fiber feed means, a fiber feed duct formed with [a] *an elongate* mouth at one end adjacent said surface *to define therewith a yarn formation line* and having walls extending from said *fiber feed* means to said *elongate* mouth wherethrough fibers from said *fiber feed* means may pass to said surface for deposit thereon, *said fiber feed duct being inclined to said yarn formation line whereby the fibers in said fiber feed duct have a component of movement parallel to said yarn formation line,*

[means for] *first suction means disposed behind a side of said yarn formation surface facing away from said fiber duct means for creating a first suction directed generally perpendicular to said yarn formation surface at said yarn formation surface, said first suction means* developing a first airstream within and along said *fiber feed* duct for movement toward said mouth for conveying said fibers from said *fiber* feed means through said mouth to said surface, means for moving said surface for twisting said deposited fibers to form a yarn, means for withdrawing said formed yarn from said surface in a direction transverse to that of said first airstream, and

*second suction* means *including a suction port disposed in said fiber feed duct which communicates with a side of said yarn formation surface facing towards said fiber duct means and opposite said first suction means* for developing a *second suction which creates* a second airstream in a portion of said *fiber feed* duct adjacent said surface *generally parallel to said surface and in a direction of said component of movement of the fibers in said fiber feed duct* for coacting said first and second airstreams whereby at least some of said fibers as they are moved toward and approach said surface are reoriented such that their fiber axes change direction to one more nearly approaching a direction parallel to that of the axis of said yarn being formed, said airstreams being substantially free of disturbance by any additional airstreams within said *fiber feed* duct.

28. Apparatus for open end spinning of yarn comprising a yarn formation surface, a fiber feed means, a fiber feed duct intercommunicating between said *fiber feed* means and said surface permitting passage therethrough of fibers from said *fiber feed* means to said surface, means for developing a first airstream within and along said *fiber feed* duct for conveying said fibers from said feed means to said surface for deposit thereon, means for moving said surface for twisting said deposited fibers to form a yarn, *said fiber feed duct being inclined to said yarn formation surface whereby the fibers in said fiber feed duct have a component of movement parallel to said yarn,* means for withdrawing said formed yarn from said surface in a direction transverse to that of said first airstream, and

*suction* means *including a suction port disposed in said fiber feed duct which communicates with a side of said yarn formation surface which faces towards said fiber feed means* for developing *a suction which creates* a second airstream within said *fiber feed* duct adjacent to said surface [in a direction transverse to that of said first airstream] *and generally parallel to said surface* so as to change the axial orientation of at least some of said conveyed fibers to adirection more nearly approaching a direction parallel to the axis of said formed yarn.

*29. An open-end yarn spinning apparatus comprising a yarn formation surface;*

*fiber feed means for feeding discrete fibers to said surface;*

*fiber duct means for conveying said fibers from said fiber feed means to said yarn formation surface;*

*surface-moving means for moving said yarn formation surface in such a manner as to twist said discrete fibers conveyed thereto and deposited thereon to form a yarn thereby;*

*yarn withdrawal means for withdrawing said formed yarn from said surface in a direction transverse to the direction of movement of said surface; and*

*fiber-entraining means including first suction means disposed behind a side of said yarn formation surface facing away from said fiber duct means for creating a first suction directed generally perpendicular to said yarn formation surface at said yarn formation surface, said first suction means producing a first airstream within said fiber duct means to entrain said discrete fibers and move the same through said fiber duct means from said fiber feed means to said yarn formation surface, said fiber duct means including a duct for containing said airstream for transporting said fibers from said fiber feed means to said surface, said duct being oblique to a yarn axis of said yarn being formed whereby said fibers within said duct have a component of movement parallel to said yarn axis, said fiber-entraining means including second suction means which includes a suction port disposed in said fiber duct means which communicates with a side of said yarn formation surface facing towards said fiber duct means opposite saidfirst suction means, said second means being effective adjacent said surface for providing a second airstream moving substantially parallel to the axis of said yarn being formed and in the same direction to said component of movement of the fibers whereby fibers entrained in said first airstream towards said surface are turned to a direction more parallel to said yarn axis as said fibers approach said yarn formation surface, and said second airstream coacting with said first airstream to provide a resultant airstream free from turbulence by and devoid of any additional airstreams introduced into said duct means.*

*30. An open-end yarn spinning apparatus comprising:*

*a yarn formation surface;*

*fiber feed means for feeding discrete fibers to said surface;*

*fiber duct means for conveying said fibers from said fiber feed means to said yarn formation surface;*

*surface moving means for moving said yarn formation surface in such a manner as to twist said discrete fibers conveyed thereto and deposited thereon to form a yarn thereby;*

*yarn withdrawal means for withdrawing said formed yarn from said surface in a direction transverse to the direction of movement of said surface; and*

*fiber-entraining means for providing an airstream within said fiber duct means to entrain said discrete fibers and move the same through said fiber duct means from said fiber feed means to said yarn formation surface, said fiber duct means being oblique to a yarn axis of said yarn being formed whereby said fibers within said duct have a component of movement parallel to said yarn axis;*

*wherein said fiber duct means includes*

*(a) a first duct extending from said fiber feed means to adjacency of said fiber formation surface,*

*(b) a second duct contiguous with said first duct adjacent to said first surface and extending away therefrom, and*

*(c) an elongate mouthpiece formed at the joining of said first and second ducts, facing an opening along said yarn formation surface in a manner parallel to the axis of said yarn being formed there, whereby said fiber-entraining means provides a component airstream moving along said second duct substantially parallel to the axis of said yarn being formed and in the same direction to said component of movement of the fibers whereby fibers entrained in said airstream towards said surface are turned to a direction more parallel to said yarn axis as said fibers approach said yarn formation surface.*

* * * * *